US011759007B2

(12) United States Patent
Lamb et al.

(10) Patent No.: US 11,759,007 B2
(45) Date of Patent: Sep. 19, 2023

(54) HEATING DEVICE

(71) Applicant: INNERFLAME PTY LTD, Mittagong (AU)

(72) Inventors: Michael Lamb, Mittagong (AU); Darren Ritchie, Mittagong (AU); Taran Singh, Mittagong (AU)

(73) Assignee: INNERFLAME PTY LTD, Mittagong (AU)

( * ) Notice: Subject to any disclaimer, the term of this patent is extended or adjusted under 35 U.S.C. 154(b) by 155 days.

(21) Appl. No.: 17/253,818

(22) PCT Filed: Jun. 18, 2019

(86) PCT No.: PCT/AU2019/050627

§ 371 (c)(1),
(2) Date: Dec. 18, 2020

(87) PCT Pub. No.: WO2019/241837

PCT Pub. Date: Dec. 26, 2019

(65) Prior Publication Data

US 2021/0112973 A1 Apr. 22, 2021

(30) Foreign Application Priority Data

Jun. 19, 2018 (AU) ..... 2018902186
Jan. 24, 2019 (AU) ..... 2019900215

(51) Int. Cl.
*A47B 31/02* (2006.01)
*F24C 15/36* (2006.01)
(Continued)

(52) U.S. Cl.
CPC ..... *A47B 31/02* (2013.01); *F24C 15/36* (2013.01); *F24H 3/006* (2013.01); *F24H 9/02* (2013.01); *F24H 9/1881* (2013.01)

(58) Field of Classification Search
None
See application file for complete search history.

(56) References Cited

U.S. PATENT DOCUMENTS 8,955,467 B1 * 2/2015 Horne ..... F22B 7/12 122/18.4
2008/0272109 A1 11/2008 Bland et al.
2013/0125371 A1 * 5/2013 Debus ..... B32B 17/06 29/464

FOREIGN PATENT DOCUMENTS

CN 205306344 U 6/2016
DE 102010011575 A1 9/2011
(Continued)

OTHER PUBLICATIONS

International Search Report and Written Opinion dated Aug. 9, 2019 for corresponding International Application No. PCT/AU2019/050627, 9 pages.

(Continued)

*Primary Examiner* — Jason Lau
(74) *Attorney, Agent, or Firm* — MH2 Technology Law Group, LLP

(57) ABSTRACT

A heating device includes a base member and a gas burner mounted in or on the base member. An upper housing located above the base member and a tabletop mounted above the upper housing. A hollow heat shield having a proximal end located on or near the base member, and a distal end located within the upper housing, and a support member extending between the base member and the upper housing or tabletop. The distal end of the heat shield extends beyond a proximal end of the upper housing, defining a region of vertical overlap between the heat shield and the upper housing.

20 Claims, 5 Drawing Sheets

(51) Int. Cl.

| | |
|---|---|
| ***F24H 3/00*** | (2022.01) |
| ***F24H 9/02*** | (2006.01) |
| ***F24H 9/1881*** | (2022.01) |

(56) References Cited

FOREIGN PATENT DOCUMENTS

| | | | | | |
|---|---|---|---|---|---|
| DE | 202012004403 | U1 | | 5/2012 | |
| DE | 202014000945 | U1 | | 3/2014 | |
| EP | 2666385 | A1 | * | 11/2013 | ..... A47B 37/04 |
| EP | 2666385 | A1 | | 11/2013 | |

OTHER PUBLICATIONS

International Preliminary Report on Patentability dated Apr. 30, 2020 for corresponding International Application No. PCT/AU2019/050627, 14 pages.

* cited by examiner

HEATING DEVICE

CROSS-REFERENCE TO RELATED APPLICATIONS

This application is a U.S. National Stage application of Int'l Application No. PCT/AU2019/050627 filed 18 Jun. 2019, which claims priority to Australian Patent Application No. 2018902186 filed 19 Jun. 2018, and Australian Patent Application No. 2019900215 filed 24 Jan. 2019, the entire disclosures of which are hereby incorporated by reference in their entireties.

TECHNICAL FIELD

The present invention relates to a heating device. In particular, the present invention relates to a heating device for use in outdoor settings, such as courtyards, decks, balconies, gardens and other open spaces. The device may be used in large commercial, non-residential indoor areas using oxygen depletion shutoff ODS. The heating device has particular application in hospitality, although it may also be used in residential and other settings.

BACKGROUND OF THE INVENTION

Outdoor heating devices are commonly used in restaurants and cafes and other hospitality venues during the colder months when ambient outdoor temperatures are not suitable for patrons and other users to comfortably spend time outside for prolonged periods. The use of outdoor heaters serves the purpose of locally raising the temperature, making the conditions enjoyable, and enabling patrons to spend longer periods of time outdoors without experiencing excessive discomfort. The use of such outdoor heating devices permits some venues to increase their useable floor area, and hence revenue, during the colder months.

Efficiently heating outdoor or large open spaces can be a difficult task, as heat dissipation to the atmosphere occurs quickly, especially in conditions with strong breezes which can quickly dissipate the heat, and also cause gas powered burners to unintentionally blow-out.

Gas burning free standing heaters are commonly used outdoors, and normally burn propane. This style of heater generally burns the gas in a raised burner, located on a stem above normal standing head height. In such heaters, the gas cylinder is normally stored in a housing located at the base of the unit, close to the ground. At the upper end of the heater, above the burner, there is a reflector, intended to reflect heat downwardly. There are several disadvantages with this style of heater. Firstly, if used under a ceiling or awning, there is a risk of fire and heat damage to the structure above the heater, if the clearance above the reflector in not sufficiently large.

Furthermore, this style of heater is known to perform poorly in windy conditions, as the heat is readily dissipated. There are also risks of patrons being burned by the head of the heater, where the baffle may be extremely hot.

In recent years there has been a trend toward the use of wall and ceiling mounted electric strip heaters. Such strip heaters are usually mounted to a wall or support structure, and configured to direct the heat downwardly from above the patrons.

Strip heaters are most suitable for installations where there is an umbrella, awning or other such structure mounted above the strip heater. This is because heat rises, and if positioned in the open, with no upper heat shield, a majority of the heat generated will be quickly lost upwardly.

Electric heaters generally are not capable of generating the same amount of heat output as gas burning heaters, and as such can only heat a comparatively smaller area per heating element. Alternatively, a greater number of electric heaters can be deployed, but such installations can be expensive to install and run.

OBJECT OF THE INVENTION

It is an object of the present invention to substantially overcome or at least ameliorate one or more of the above disadvantages, or to provide a useful alternative.

SUMMARY OF THE INVENTION

A heating device comprising:

a base member;

a gas burner mounted in or on the base member;

an upper housing located above the base member;

a tabletop mounted above the upper housing;

a hollow heat shield having a proximal end located on or near the base member, and a distal end located within the upper housing, and at least one support member extending between the base member and the upper housing or tabletop;

wherein the distal end of the heat shield extends beyond a proximal end of the upper housing, defining a region of vertical overlap between the heat shield and the upper housing;

further wherein the heat shield has a tapering profile with a cross sectional area that decreases between a proximal end located at the base member and a distal end adjacent to the upper housing.

In one embodiment, the heat shield is defined by a truncated pyramid or cone which is open at a truncated end.

The truncated end, in some examples, is located adjacent to and beneath an underside surface of the tabletop, and separated by a clearance.

In one embodiment, the heat shield is a right cylindrical tube.

The base member, in some examples, includes an air flow port in fluid communication with a central void located within the heat shield.

The vertically extending blades, in some examples, are mounted around the heating device and extend between the base member and the upper housing or tabletop.

The blades, in some examples, each extend radially.

The tabletop, in some examples, is defined by upper and lower tempered glass sheets separated by an air space.

The upper tempered glass sheet, in some examples, is seated on an annular steel disc connected to the upper housing.

An internal wall of the upper housing, in some examples, is shielded with a heat proof insulator.

A glass disc, in some examples, is seated on a distal end of the upper housing beneath the tabletop.

A central void located within the heating device support portion between the base member and the upper housing is visible between the blades, in some examples.

A footrest is located around the base member, in some examples.

A generally annular clearance is defined between the distal end of the heat shield and an inner wall of the upper housing, in some examples.

The distal end of the heat shield is mounted to the upper housing with one or more resilient members, in some examples.

The heat shield, in some examples, is fabricated from glass, and defines the lateral walls of an internal combustion chamber.

In an alternative embodiment, the heat shield may have a right circular cylindrical profile, such that the cross-sectional area of the heat shield is generally constant between the proximal end and the distal end.

In either of the tapering or right cylindrical embodiments, the heat shield provides a heat break between the internal combustion chamber and the outer blades or mesh.

A mesh, perforated screen or other such air and heat permeable barrier may be located between the base member and the upper housing.

The upper tempered glass sheet is seated on an annular steel disc (or other suitable material) connected to the upper housing, in some examples. For example, the annular disc may be fabricated from toughened glass or ceramic.

A central void, in some examples, is located within the heating device support portion between the base member and the upper housing and is visible between the blades or a mesh outer layer.

Primary air is entrained through an injector nipple, in some examples. As such, primary air enters through an airflow port located in the base member and secondary air enters through a clearance located beneath a proximal portion of the heat shield.

BRIEF DESCRIPTION OF THE DRAWINGS

An embodiment of the invention will now be described by way of specific example with reference to the accompanying drawings, in which.

DETAILED DESCRIPTION OF THE EMBODIMENTS

Figure 1:
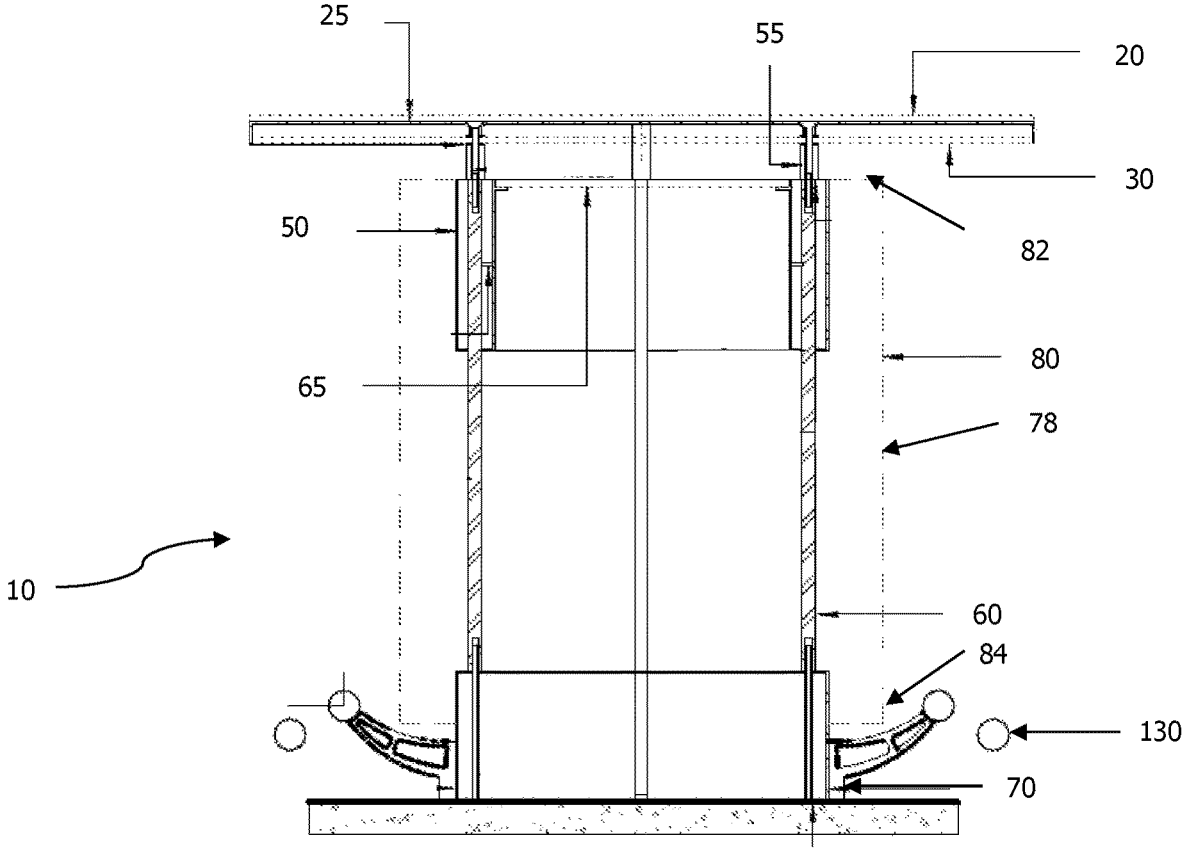
FIG. 1 is a cross-sectional side view of a heating device according to an embodiment of the invention.

A heating device 10 is provided having a secondary function in the form of a portable table or bar unit. The heating device 10 includes an upper tabletop surface 20 which provides a tabletop for users to interact with. As such, patrons may congregate around the table for shared meals and drinks, while being heated by the device 10.

The device 10 is intended to be a semi-permanent furniture installation, which is not portable, but designed to be installed in a desired location for extended periods of operation. For example, it may be installed in a restaurant or bar for the winter months only, or alternatively for continuous year round usage.

The device 10 may be fabricated in different heights ranging from coffee table heights of around 650 mm to typical table height of around 750 mm up to taller bar models intended for standing patrons.

It will be appreciated that whilst the device 10 is described and depicted with a round table top surface 20, it may alternatively be provided as a square table top, or as an elongated model, in the form of a bar or bench.

In the embodiment depicted, the upper tabletop surface 20 of the heating device 10 is defined by a 10 mm round tempered glass sheet. The upper tabletop surface 20 is seated on an annular steel disc 25 preferably fabricated from weathering steel or mild steel, or some other suitable and approved material.

In one embodiment, the upper tabletop surface 20 may be defined by a stone slab, an artificial stone material, or some other decorative material.

Beneath the upper tabletop surface 20 is a vertically separated lower tabletop surface 30, also defined by a 10 mm round tempered glass sheet, or another suitable material. The upper and lower tabletop surfaces 20, 30 are separated by an air gap which is located beneath the annular steel disc 25. The air gap provides thermal insulation. The air gap is preferably in the range of 20 mm-60 mm in thickness, and most preferably 40 mm to 55 mm.

The air gap thermally isolates the table from the heat source.

The upper and lower tabletop surfaces 20, 30 and the annular disc 25 are seated on an upper housing 50 with spacers 55 which are configured to receive screws inserted through the steel disc 25 from above. The screws then engage with threaded holes located in the upper housing 50. The lower tabletop surface 30 has holes formed therein to receive the screws.

Insulation 40 may be located in the airgap between the annular steel disc 25 and the lower tabletop surface 30. The insulation 40 is preferably in the shape of an annular disc when viewed from above, having a central hole. The annular disc of insulation 40 extends to or near the outer circumference of the upper and lower tabletop surfaces 20, 30.

The upper and lower tabletop surfaces 20, 30 are mounted to the upper housing 50, which is generally cylindrical. The upper and lower tabletop surfaces 20, 30 extend radially beyond the upper housing 50, defining a clearance for the user's legs when seated at the device 10.

The upper housing 50 is supported by a plurality of support members 60. In the embodiment depicted in the drawings, the support members 60 are defined by steel SHS sections. However, it will be appreciated that other profile of support member 60 may alternatively be used, such as RHS, or cylindrical tube, or a combination thereof.

The support members 60 are each mounted at a proximal end to a base 70, which is seated on a ground surface when in use.

The base 70 is fabricated from a cylindrical steel unit, which has the same or a similar diameter to the upper housing 50. Air is able to flow into a central void located in the device 10 between the adjacent vertical support members 60 on account of at least one lateral opening formed in a side of the heating device 10 between the base member 70 and the upper housing 50.

Figure 2:
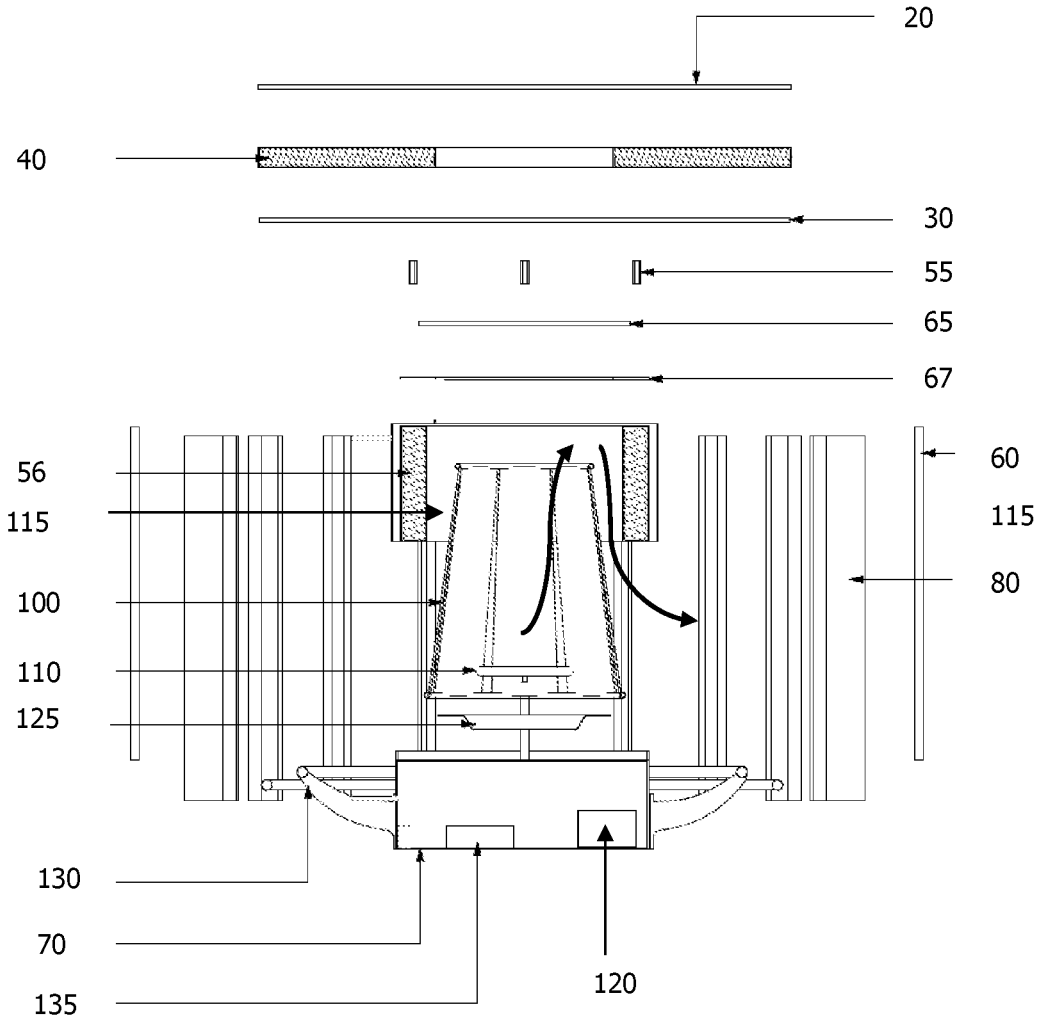
FIG. 2 is an exploded view of the heating device of FIG. 1.
Figure 3:
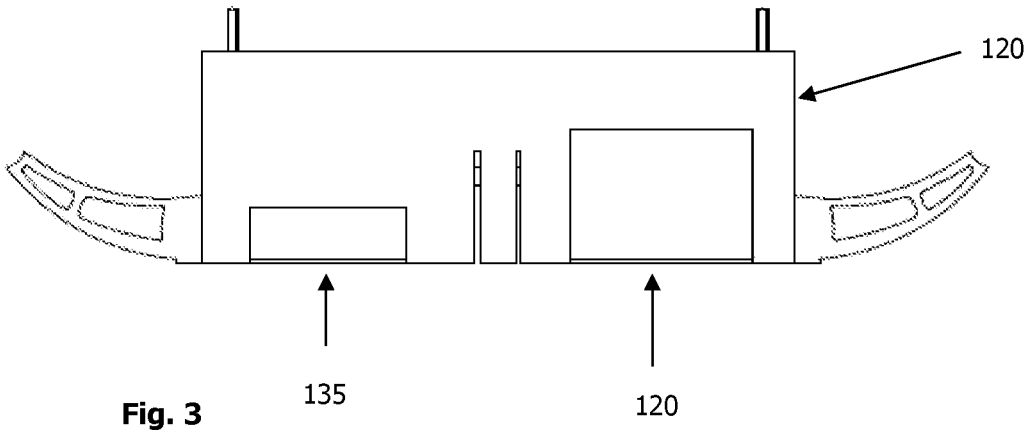
FIG. 3 is a side detail of the base of the heating device.
Figure 4:
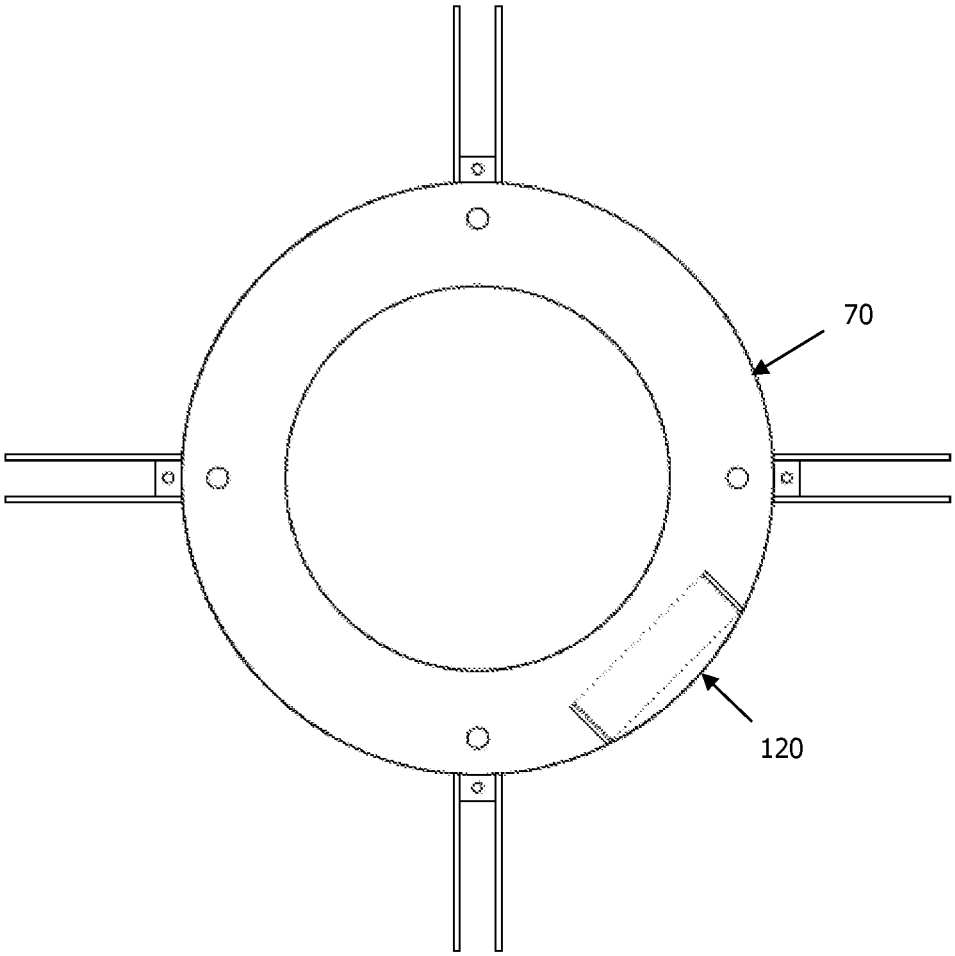
FIG. 4 is a top detail of the base of the heating device.

Referring to FIG. 2, a heat shield or baffle 100 is located within the device 10, and has a proximal end located on or near the base member 70. The heat shield 70 directs the heated air and exhaust gasses upwardly, toward the upper housing 50, and provides a shield to prevent the flame from being blown by lateral wind/breezes. As such, the heat shield eliminates or at least significantly reduces the likelihood of users being burned by the device 10.

Primary air is entrained through an injector nipple with airflow port 135 formed in the base member 70. Secondary air is entrained through a clearance located between a support stand 72 and under the proximal base of the heat shield or baffle 100.

A glass disc 65 is positioned on the top of the housing 50. The disc 65 prevents or at least limits heat from dissipating upwardly, through the upper tabletop surface 20. The glass disc 65 is transparent, permitting patrons to see the flames from above the upper tabletop surface 20. The glass disc 65 is seated on a steel flange 67.

In one embodiment, a lens may be located in the table top for viewing the internal flame.

A layer of insulation 56 is located in the upper housing 50. The insulation 56 lines the internal wall of the housing 50, preventing or at least inhibiting heat from being dissipated radially outwardly through the housing 50.

A decorative outer layer 78 defines the radially outermost portion of the device, adjacent to the heat shield 100. The decorative outer layer 78 may be provided in the form of a mesh screen, a perforated screen, a plurality of vertical blades 80 (described below), a plurality of horizontal bars, or some other arrangement which is at least partially heat and air impermeable.

The decorative outer layer 78 may be applied with apertures in the form of a pattern which may identify for example a logo, company branding, advertising or some other customer specific artwork.

In the embodiment depicted, a plurality of vertical blades 80 extend between the base 70 and the upper housing 50, parallel with the support members 60. The blades 80 are each supported at an upper edge with a holder 82, which is welded or otherwise secured to the upper housing 50. In a similar manner, the blades 80 are also each supported and secured at a lower edge with a holder 84, which is welded or otherwise secured to the base 70.

Each of the blades 80 or decorative mesh extends radially outwardly around the circumference of the upper housing 50 and base 70. The blades 80 provide a physical shield which enables heat to radiate outwardly, but prevents a person from becoming too close to the heat source, thereby minimising the risk of injury, or contact with the heat shield 100. Furthermore, the blades 80 assist to trap heat close to the device 10, partially countering the effect of heat dissipation by breezes or other air disturbances.

The blades 80 or mesh are preferably fabricated from compressed fibre cement, concrete, timber, steel, other metals, glass, resin or some other material capable of withstanding temperatures significantly above ambient temperatures without being burned or becoming structurally compromised.

Figure 5:
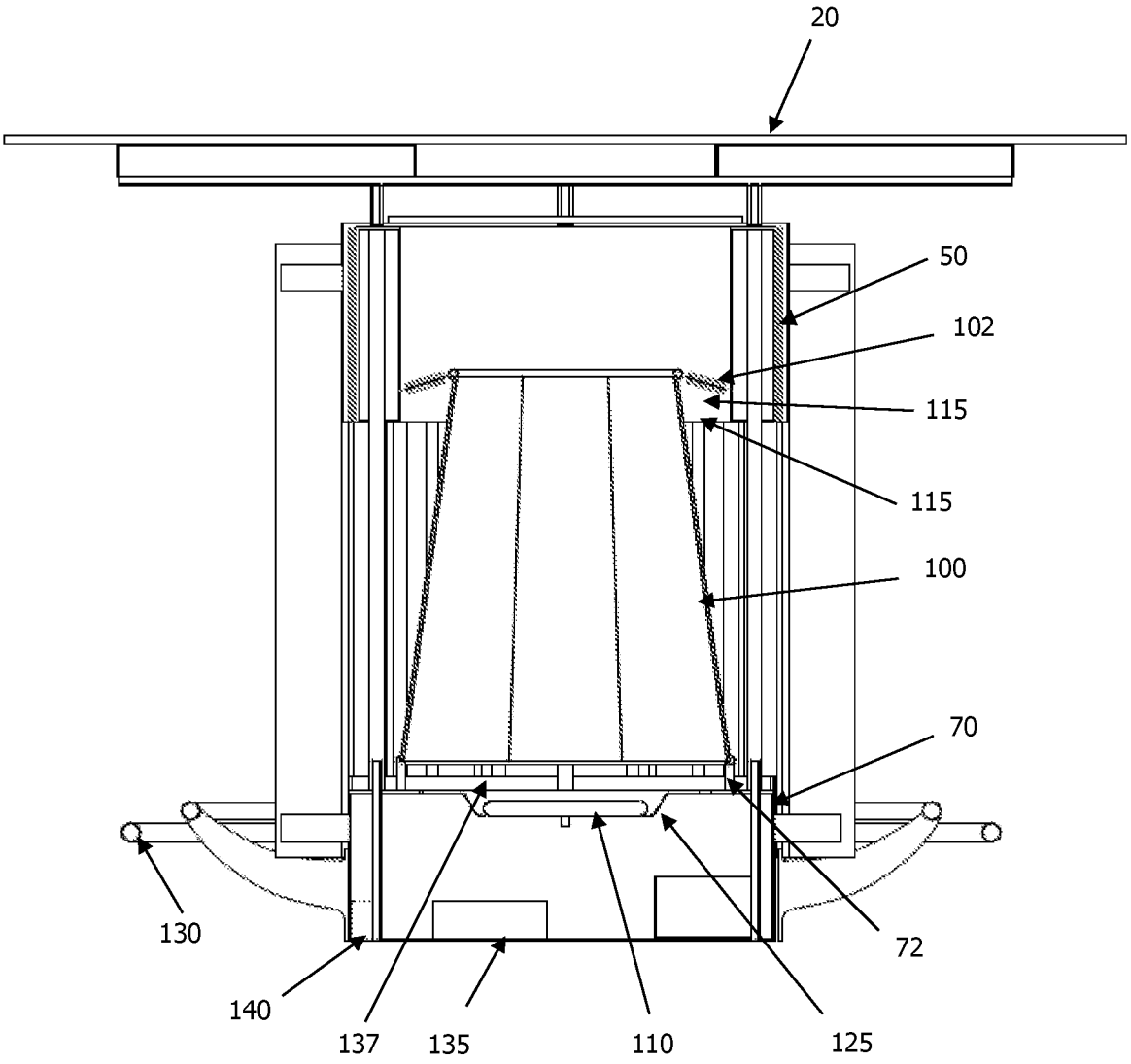
FIG. 5 is a side view of the heating device with the blades partially removed.
Figure 6:
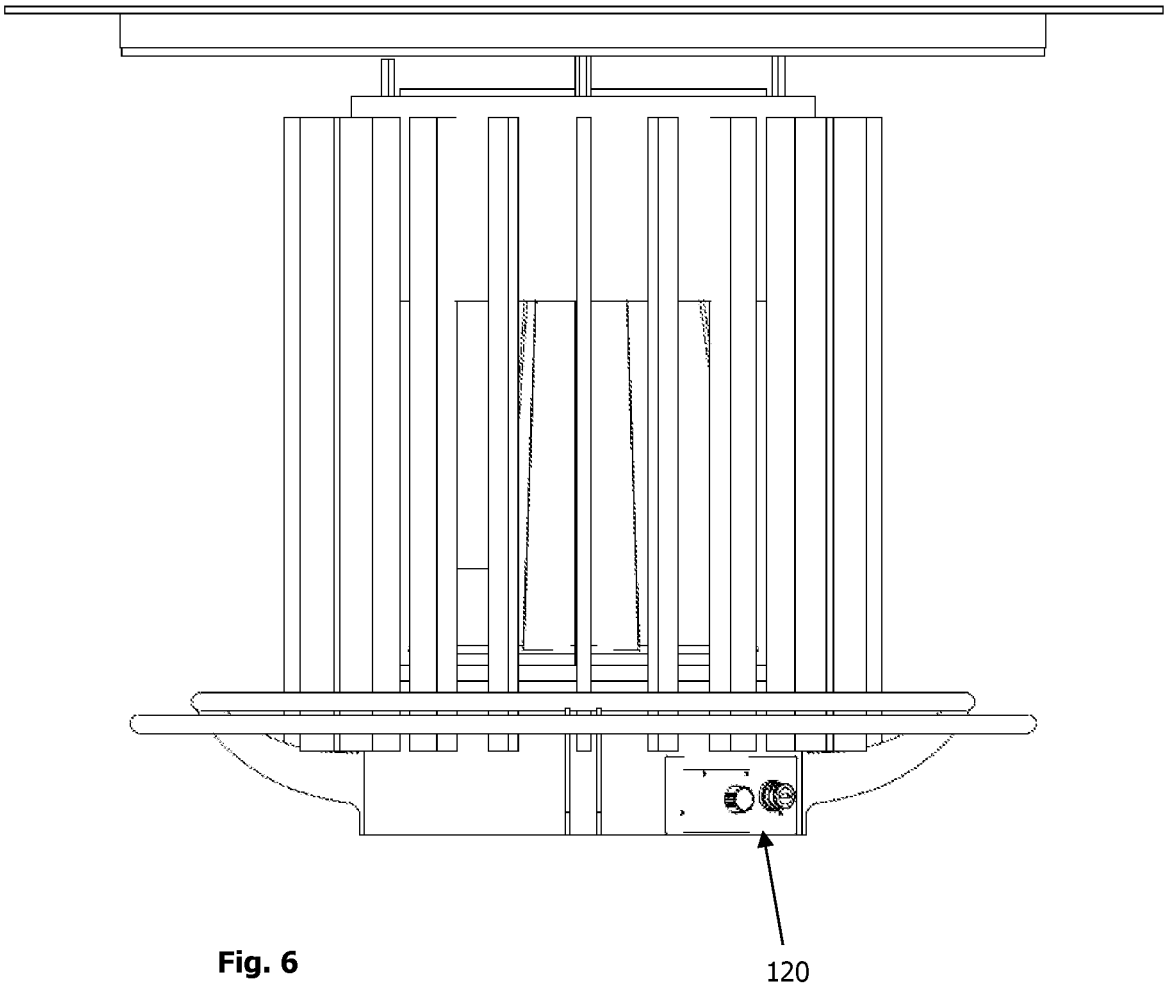
FIG. 6 is a side view of the heating device with the blades included.

Referring to FIG. 5, the heat shield 100 is mounted in the cylindrical space located between the upper housing 50 and the base 70. In the embodiment depicted, the heat shield 100 is in the form of a hollow polyhedron, which tapers inwardly as it extends upwardly, such that the cross sectional area of the heat shield 100 is smallest at the top. In the embodiment depicted, the glass polyhedron 100 has the form of a truncated pyramid, preferably having between 3 and 10 side surfaces, and most preferably 8 surfaces. However, it will be appreciated that in other embodiments, the heat shield may be defined by a truncated cone, or a right circular cylindrical member.

The heat shield may be a single or multiple piece fabrication. A multiple piece fabrication, preferably having two halves, allows for easy separation and removal for service and maintenance purposes, and access to the internal burner.

The heat shield 100 is open at the top. The housing of the heat shield 100 may be held by springs 102 located at the top, and extending to the inner wall of the upper housing 50, as depicted in FIG. 5. The springs 102 assist to prevent the heat shield 100 from being unintentionally moved, or knocked over.

A burner 110 is located within the heat shield 100. The burner 110 may be a reticulated liquid petroleum gas (LPG) or a natural gas burner. The burner 110 is seated on a stainless steel tray 125, and the burner is intended for connection to a reticulated gas source.

A clearance 115 is defined between the upper end of the heat shield 100 and the inner wall of the housing 50. In the embodiment depicted, the clearance 115 is generally annular in profile (when viewed from above). Furthermore, a distal end of the heat shield 100, located furthest from the burner 110, extends beyond a proximal end of the upper housing, defining a region of vertical overlap between the heat shield 100 and the upper housing 50, such that the heat shield extends vertically above the lower edge of the upper housing 50.

A foot rest 130 may be mounted to the base 80. In the embodiment depicted in the drawings, the foot rest 130 is defined by a pair of interconnected rings having different diameters. However, it will be appreciate that a single ring may alternatively be used, and other configurations are envisaged which serve the purpose of holding a user's feet above the ground when seated at the heating device 10. It will also be appreciated that the foot rest may be omitted from some embodiments of the heating device 10.

One or more airflow ports 135 are mounted in the base 70. The airflow ports 135 permit air to enter the heating device 10 to feed the combustion process at the burner 110.

The operation of the heating device 10 will now be described. The device 10 is turned on by the control unit 120, located in the base 70, or alternatively the device 10 may be remotely controlled. The heat output can be manually adjusted between various settings such as low, medium and high, by way of a gas flow valve adjustment. The control unit 120 may also include a starter to initiate a spark. Alternatively, the starter may be automatically operated when the gas flow valve is opened. The control unit 120 may be automated by use of electronic ignition, or a remote control.

Once the heating device 10 has been started, the flame burns at the burner 110 which is located inside the glass heat shield 100. The flame can be seen through the sides of the heating device 10 between the blades 80 or decorative mesh. In addition, the flame can be seen through the upper tabletop surface 20.

Ambient air is drawn into the injector through the airflow port 135 and secondary air via the gap 137 provided beneath the heat shield 100.

The heat and exhaust gasses travel upwardly through the glass heat shield 100. When the heat reaches the top of the glass prism 100, it is directed laterally. However, the insulation 56 and the body of the upper housing 50 prevents the heat from continuing laterally, and the annular clearance 115 enables the heated air to exit downwardly. This occurs because the distal end of the heat shield 100, located within the upper housing 50, extends vertically beyond a proximal, lowermost end of the upper housing 50, defining a region of vertical overlap between the heat shield 100 and the upper housing 50, in the form of the annular clearance 115.

Due to the annular clearance 115 extending around the entire circumference of the device 10, the heat and exhaust gasses are dissipated evenly around the circumference of the table, thereby providing even heat distribution for users.

As such, heated air and exhaust gasses cannot continue upwardly, due to the table top, so the heated air travels radially outwardly, and must exit the device in a partially downward direction, in order to be able to clear the proximal end of the upper housing 50.

Advantageously, in the embodiment where the heat shield 100 is tapered, and having a reduced cross-sectional profile toward the distal end, the tapering results in the heated air being drawn into and upward through the heat shield 100, resulting in improved heating performance.

The heated air then exits the device 10 between the plurality of vertical blades 80, or apertures in the decorative mesh screen of the decorative outer layer 78. The direction of flow of the heated air is depicted schematically by the arrow in FIG. 2.

In addition, heat is transmitted through the wall of the heat shield 100 by convection and conduction.

Accordingly, the combination of flow of heated air, and convection/conduction results in a significant heat output at/near the user's legs, beneath the table top.

The blades 80 or decorative outer layer 78 assists to trap the heated air close to the device 10, countering the effect of heat dissipation by breezes or other air disturbances. In addition, the underside of the lower tabletop surface 30 acts as a barrier to prevent the heated air from rising, thereby slowing heat dissipation, and retaining the heated air at or near the seated or standing patron's legs.

Advantageously, the heating device 10 has a higher heat output than conventional outdoor heaters, as the burner 110 is located at the base.

Advantageously, the heating device 10 provides improved carbon dioxide dissipation.

Advantageously, the heated air and exhaust gasses exit the device 10 between the blades 80 or through apertures in the decorative mesh layer 78, near a user's legs, when the user is seated or standing near the device 10. This is beneficial as heat rises, so the heat tends to stay close to the user for longer, especially in calm conditions.

The heating device 10 includes a plurality of adjustable feet 140. The feet 140 can be used to level the tabletop 20. Furthermore, the adjustable feet 140 can be secured to the floor to isolate the heating device 10 and prevent it from being unintentionally moved. This prevents the gas supply line from being damaged.

In one embodiment the heating device 10 may have an umbrella or shade device mounted to it. The umbrella can be used to provide sun protection, or alternatively to trap heat generated by the burner 110.

Although the invention has been described with reference to specific examples, it will be appreciated by those skilled in the art that the invention may be embodied in many other forms.

The claims defining the invention are as follows:

1. A heating device comprising:

a base member;

a gas burner mounted in or on the base member;

an upper housing located above the base member;

a tabletop mounted above the upper housing;

a hollow heat shield having a proximal end located on or near the base member, and a distal end located within the upper housing, and at least one support member extending between the base member and the upper housing or tabletop;

wherein the distal end of the heat shield extends beyond a proximal end of the upper housing, defining a region of vertical overlap between the heat shield and the upper housing;

further wherein a glass disc is seated on a distal end of the upper housing beneath the tabletop; and further wherein the distal end of the heat shield is mounted on the upper housing with one or more resilient members.

2. The heating device of claim 1, wherein the heat shield is defined by a truncated pyramid or cone which is open at a truncated end, the heat shield having a tapering profile with a cross sectional area that decreases between the proximal end located at the base member and the distal end adjacent to the upper housing.

3. The heating device of claim 2, wherein the truncated end is located adjacent to and beneath an underside surface of the tabletop, and separated by a clearance.

4. The heating device of claim 1, wherein the heat shield is a right cylindrical tube.

5. The heating device of claim 1, wherein the base member includes an air flow port in fluid communication with a central void located within the heat shield.

6. The heating device of claim 1, wherein vertically extending blades are mounted around the heating device and extend between the base member and the upper housing or the tabletop.

7. The heating device of claim 6, wherein the blades each extend radially.

8. The heating device of claim 1, wherein the tabletop is defined by upper and lower tempered glass sheets separated by an air space.

9. The heating device of claim 8, wherein the upper tempered glass sheet is seated on an annular steel disc connected to the upper housing.

10. The heating device of claim 8, wherein an internal wall of the upper housing is shielded with a heat proof insulator.

11. The heating device of claim 7, wherein a central void located within at least one support member between the base member and the upper housing is visible between the blades.

12. The heating device of claim 1, wherein a footrest is located around the base member.

13. The heating device of claim 1, wherein a generally annular clearance is defined between the distal end of the heat shield and an inner wall of the upper housing.

14. The heating device of claim 1, wherein primary air enters through an airflow port located in the base member and secondary air enters through a clearance located beneath the proximal portion of the heat shield.

15. A heating device comprising:

a base member;

a gas burner mounted in or on the base member;

an upper housing located above the base member;

a tabletop mounted above the upper housing, wherein the tabletop is defined by an upper tempered glass sheet and a lower tempered glass sheet separated by an air space, and wherein the upper tempered glass sheet is seated on an annular steel disc connected to the upper housing;

a hollow heat shield having a proximal end located on or near the base member, and a distal end located within the upper housing, and at least one support member extending between the base member and the upper housing or tabletop;

wherein the distal end of the heat shield extends beyond a proximal end of the upper housing, defining a region of vertical overlap between the heat shield and the upper housing; and further wherein a glass disc is seated on a distal end of the upper housing beneath the tabletop.

16. The heating device of claim 15, wherein the heat shield is defined by a truncated pyramid or cone which is open at a truncated end, the heat shield having a tapering profile with a cross sectional area that decreases between the proximal end located at the base member and the distal end adjacent to the upper housing.

17. The heating device of claim 16, wherein the truncated end is located adjacent to and beneath an underside surface of the tabletop, and separated by a clearance.

18. The heating device of claim 15, wherein the heat shield is a right cylindrical tube.

19. The heating device of claim 15, wherein the base member includes an air flow port in fluid communication with a central void located within the heat shield.

20. The heating device of claim 15, wherein vertically extending blades are mounted around the heating device and extend between the base member and the upper housing or the tabletop.

* * * * *